US008135290B2

(12) United States Patent
Shimizu

(10) Patent No.: US 8,135,290 B2
(45) Date of Patent: Mar. 13, 2012

(54) IMAGE FORMING APPARATUS

(75) Inventor: Akihiro Shimizu, Tokyo (JP)

(73) Assignee: Canon Kabushiki Kaisha (JP)

( * ) Notice: Subject to any disclaimer, the term of this patent is extended or adjusted under 35 U.S.C. 154(b) by 507 days.

(21) Appl. No.: 12/480,836

(22) Filed: Jun. 9, 2009

(65) Prior Publication Data

US 2009/0304398 A1 Dec. 10, 2009

(30) Foreign Application Priority Data

Jun. 10, 2008 (JP) ..... 2008-151189

(51) Int. Cl.
*G03G 15/00* (2006.01)

(52) U.S. Cl. ..... 399/21; 399/18; 399/400

(58) Field of Classification Search ..... 399/21, 399/400, 18, 19, 22
See application file for complete search history.

(56) References Cited

U.S. PATENT DOCUMENTS

| | | | | |
|---|---|---|---|---|
| 4,825,245 | A * | 4/1989 | Fukae et al. | 399/110 |
| 6,347,196 | B1 * | 2/2002 | Kawabata et al. | 399/16 |
| 2004/0156663 | A1 * | 8/2004 | Omata et al. | 399/400 |
| 2007/0237530 | A1 * | 10/2007 | Sunada | 399/21 |

FOREIGN PATENT DOCUMENTS

| | | | |
|---|---|---|---|
| JP | 5-193790 | A | 8/1993 |
| JP | 8-272229 | A | 10/1996 |

* cited by examiner

*Primary Examiner* — Judy Nguyen
*Assistant Examiner* — Blake A Tankersley
(74) *Attorney, Agent, or Firm* — Rossi, Kimms & McDowell LLP

(57) ABSTRACT

An image forming apparatus which can draw out a pre-fixing conveying portion and a fixing device from an apparatus body has an abutment member which can abut a conveying surface of the pre-fixing conveying portion and can be separated therefrom, the abutment member being separated from the conveying surface of the pre-fixing conveying portion when the apparatus body is operated and abutting the conveying surface of the pre-fixing conveying portion in the event that a jam is detected by a sheet detection sensor.

3 Claims, 5 Drawing Sheets

IMAGE FORMING APPARATUS

BACKGROUND OF THE INVENTION

1. Field of the Invention

The present invention relates to an image forming apparatus, such as a copying machine, a printer, a recorded image display device, and a facsimile, forming a visible image by an electrophotographic system.

2. Description of Related Art

For example, in recent years, as a multiple function processing machine and a facsimile having a copy and printer function, an image forming apparatus of an electrophotographic system has been widely used. Then, the image forming apparatus of an electrophotographic system has been required to be faster, reduce the cost, and improve user operability.

In the image forming apparatus which forms an image on a horizontally conveyed sheet, a configuration which transfers the image onto the lower surface of the sheet in a vertical direction is used. In the case of one-side image formation, the sheet is discharged with its transfer side facing downward from the image forming apparatus without being reversed. The image forming apparatus discharges the sheet in the page order without reversing the sheet. Accordingly, the reversing time of the sheet can be unnecessary so that the image forming apparatus can be faster.

In such a configuration, a sheet conveying path from a transfer portion via a fixing device to a discharge portion is arranged above an image forming portion. Due to this, the sheet onto which an unfixed image is transferred by the transfer portion is conveyed to the fixing device by absorbing the upper surface of the sheet in a vertical direction.

The image forming apparatus will be generally described. In FIG. 6, reference numeral 1 denotes an apparatus body and process units 4*a* to 4*d* which individually form primary images of yellow, magenta, cyan, and black colors are arranged in the apparatus body 1.

An original to be image formed is read by an original reading device 2 so as to be converted to image data and is then output from each of laser scanners 3 for the respective colors. Reference numeral 9 denotes an intermediate transfer belt and a toner image primarily transferred onto the intermediate transfer belt 9 is transferred onto a sheet by a secondary transfer roller 10.

The sheet is conveyed via a longitudinal conveying path 13 to a pair of registration rollers 14. The pair of registration rollers 14 adjust the timing of sheet conveyance relative to skew feeding correction of the sheet and image writing.

On the downstream side of the image forming portion, there are provided a fixing device 16 which fixes the toner image onto the sheet as a permanent image and a pre-fixing conveying portion 31 which absorbs and conveys the sheet to the fixing device 16. Upper and lower guide portions forming the conveying path are provided. Either of the guide portions is separated. When the jam recovery operation of the apparatus body 1 is performed, the user separates the guide portion to remove the sheet.

For example, when there is a jammed sheet near the pre-fixing conveying portion 31, the pre-fixing conveying portion 31 is opened in an arrow C direction to perform the jam recovery operation in a space formed thereby (see Japanese Patent Application Laid-Open No. 5-193790).

To achieve the high productivity of the image forming apparatus, the jam recovery need be performed immediately. As illustrated in FIG. 7, an upper portion D including the original reading device 2 and the pre-fixing conveying portion 31 is provided in the apparatus body 1 so as to be opened and closed. The jam recovery operation of a sheet P on the conveying path from the pre-fixing conveying portion 31 to the fixing device 16 is performed in a space formed when the upper portion D is opened (see Japanese Patent Application Laid-Open No. 8-272229).

In JP-A No. 5-193790, the pre-fixing conveying portion 31 is opened and closed to secure the jam recovery space. However, the pre-fixing conveying portion 31 is provided in the apparatus body 1. Due to this, the amount of opening and closing the pre-fixing conveying portion 31 cannot be sufficiently secured. Accordingly, the jam recovery cannot be easily performed.

In JP-A No. 8-272229, to support the opened and closed upper portion D, high rigidity and high accuracy are required for the apparatus body 1. The cost of components and assembling can be increased.

SUMMARY OF THE INVENTION

The present invention provides an image forming apparatus which can achieve improved jam recovery properties and high productivity at low cost.

An image forming apparatus having in an apparatus body a transfer portion which transfers a toner image onto the lower surface of a sheet, a fixing device which fixes the toner image transferred by the transfer portion onto the sheet, and a conveying portion which absorbs the upper surface of the sheet with the toner image transferred onto the lower surface thereof by the transfer portion to convey the sheet to the fixing device has the following configuration.

The image forming apparatus has an abutment member provided so that the abutment member can abut the sheet conveying surface of the conveying portion, the abutment member separated from the conveying surface of the conveying portion abutting the conveying surface of the conveying portion to nip the sheet on the sheet conveying surface in the event that a jam is detected in the conveying path of the sheet.

According to the present invention, in the event of jam occurrence, the sheet is nipped between the conveying portion and the abutment member so as to be drawn out from the apparatus and the jam recovery can be performed outside the apparatus. Thus, the jam recovery properties can be improved and the stop time of the apparatus due to the jam recovery can be reduced and the productivity can be improved at low cost.

Further features of the present invention will become apparent from the following description of exemplary embodiments (with reference to the attached drawings).

DESCRIPTION OF THE EMBODIMENTS

Figure 1:
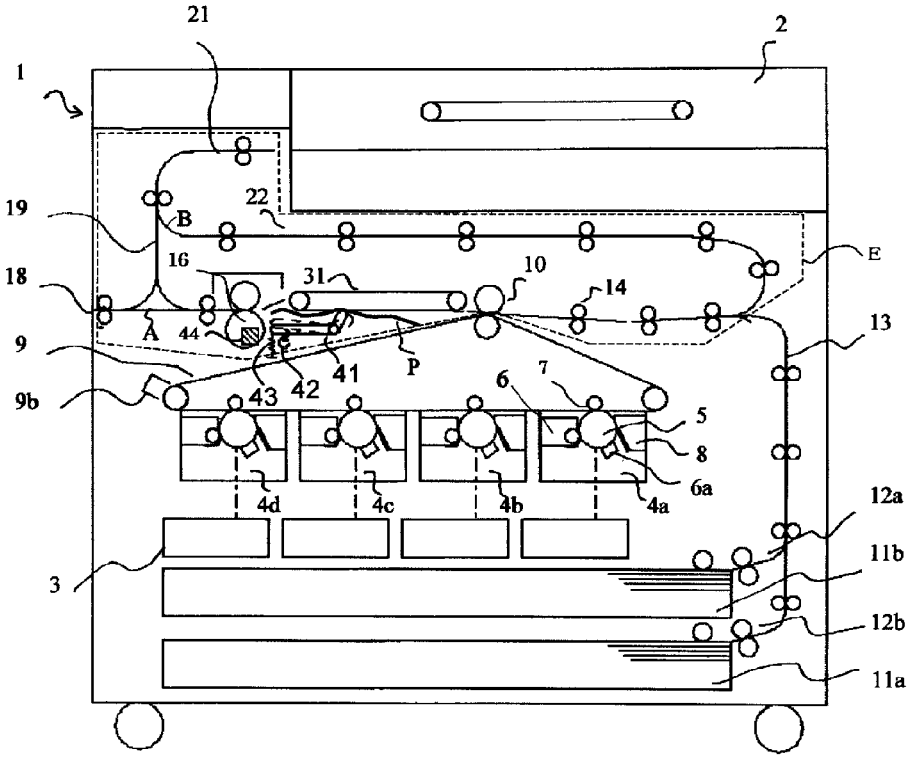
FIG. 1 is a schematic longitudinal sectional view of an image forming apparatus according to an embodiment of the present invention.

An embodiment of the present invention will be described below in detail with reference to the drawings. FIG. 1 is a schematic longitudinal sectional view illustrating an example of an image forming apparatus according to an embodiment of the present invention. Unless otherwise specified, the scope of the present invention is not limited to the dimensions, materials, shapes, controlling methods, and relative arrangements of components described in this embodiment.

In FIG. 1, reference numeral 1 denotes an apparatus body and process units 4*a* to 4*d* which individually form primary images of yellow, magenta, cyan, and black colors are arranged in the upper portion of the apparatus body 1. An image of each of the colors is formed on a photosensitive drum 5 of each of the process units 4*a* to 4*d*.

An original to be image formed is read by an original reading device 2 so as to be converted to image data and is then output from each of the laser scanners 3 for the respective colors. Each of the laser scanners 3 emits a laser onto the photosensitive drum 5 to draw an optical image according to the image data.

Each of the process units 4*a* to 4*d* for the respective colors has the photosensitive drum 5 and a charger 6*a* which uniformly charges the surface of the photosensitive drum 5. Furthermore, each of the process units 4*a* to 4*d* has a development device 6 which develops an electrostatic latent image made by drawing the optical image by the laser scanner 3 onto the surface of the photosensitive drum 5 charged by the charger 6*a* to a toner image.

Each of the process units 4*a* to 4*d* has a primary transfer roller 7 which transfers the toner image developed on the surface of the photosensitive drum 5 onto an intermediate transfer belt 9, and a cleaning unit 8 which removes the toner remained on the photosensitive drum 5 after the toner image is transferred.

The toner image primarily transferred onto the intermediate transfer belt 9 is transferred onto a sheet P by a secondary transfer roller 10.

The toner remained without being transferred by the secondary transfer roller 10 is collected by a transfer belt cleaner 9*b*. An image forming portion is formed by the process units 4*a* to 4*d* which form the primary images, the intermediate transfer belt 9, and the secondary transfer roller 10. A separation claw 51 which separates the sheet material attached to the intermediate transfer belt 9 is arranged on the downstream side of the secondary transfer roller 10.

Feeding portions 12*a* and 12*b* are located on the uppermost stream of sheet conveyance. Sheet cassettes 11*a* and 11*b* storing the sheet P are arranged in the lower portion of the apparatus body 1. The sheet P fed from the sheet cassettes 11*a* and 11*b* of the feeding portions 12*a* and 12*b* is conveyed through a longitudinal conveying path 13 to the downstream side. A pair of registration rollers 14 are provided in the lowermost stream position of the longitudinal conveying path 13. Here, the timing of skew feeding correction of the sheet P, image writing in the image forming portion, and sheet conveyance is adjusted.

On the downstream side of the image forming portion, there are provided a fixing device 16 which fixes the toner image on the sheet P as a permanent image and a pre-fixing conveying portion 31 which absorbs and conveys the sheet P to the fixing device 16. While nipping the sheet P by a pair of rotors of the fixing device 16 to convey the sheet P, the fixing device 16 fixes the toner onto the sheet P by heat from a heat generating member and the nipping pressure between the pair of rotors. The pre-fixing conveying portion (conveying portion) 31 absorbs the sheet onto a sheet conveying surface 31*a* of the conveying belt by a negative pressure or an electrostatic force and conveys the sheet by rotating the conveying belt.

The conveying path is divided into a main conveying path in which after passing through the fixing device 16, the sheet P is conveyed to a discharge roller 18 and is then discharged to a discharge tray, not illustrated, and a reversing path 19 which reverses the sheet P to form the image on the opposite side of the sheet P (duplex image formation).

The main conveying path and the reversing path 19 are switched at a branch point A by a switching member, not illustrated. In duplex image formation, after the image is fixed onto one side of the sheet P, the sheet P is conveyed to the reversing path 19 and is then conveyed to a switchback path 21.

After the trailing portion of the sheet P passes through a branch point B of the switchback path 21, the sheet P is stopped once so as to be conveyed in the opposite direction, and is then conveyed to a duplex conveying path 22 by a switching member, not illustrated, provided at the branch point B.

At this time, the sheet P is conveyed in the state that the first side thereof which is image formed faces upward. Accordingly, when the sheet P is conveyed to the image forming portion again, its opposite side which is not image formed faces upward. The image is transferred onto the opposite side of the sheet P by the secondary transfer roller 10 and is then fixed by the fixing device 16. The image formed sheet P passes through the main conveying path and is then discharged to the discharge tray, not illustrated, by the discharge roller 18.

A bent abutment member 41 having one end abutting the conveying surface of the pre-fixing conveying portion 31 is arranged below the pre-fixing conveying portion 31 and is axially supported so as to be rotatable about its bending portion. A tension spring 43 is provided on the other end of the abutment member 41 so that its one end is spring urged in the direction abutting the conveying surface of the pre-fixing conveying portion 31.

A cam 42 is provided near the tension spring 43. The cam 42 is driven to perform the abutting and separating operations of the abutment member 41. The driving of the cam 42 is operated by a driving source, not illustrated, or is performed by a motor 44 which drives the pair of fixing rollers of the fixing device 16.

In the drawing, a conveying unit E indicated by a dotted line portion is supported so as to be drawn out from the apparatus body 1 at the same time. In the event of jam occurrence, the conveying unit E is drawn out from the apparatus body 1 by a handle, not illustrated, to perform the jam recovery operation.

Figure 2:
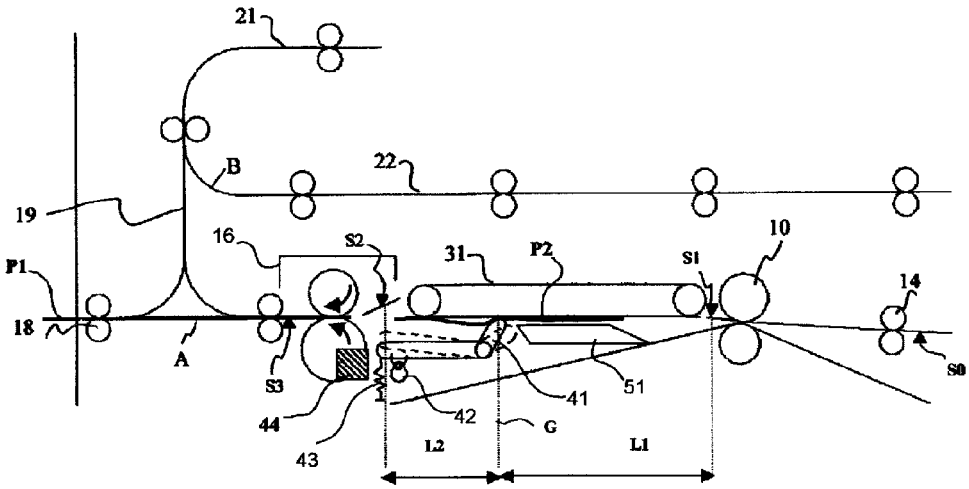
FIG. 2 is an essential portion enlarged sectional view of the image forming apparatus illustrated in FIG. 1.
Figure 3:
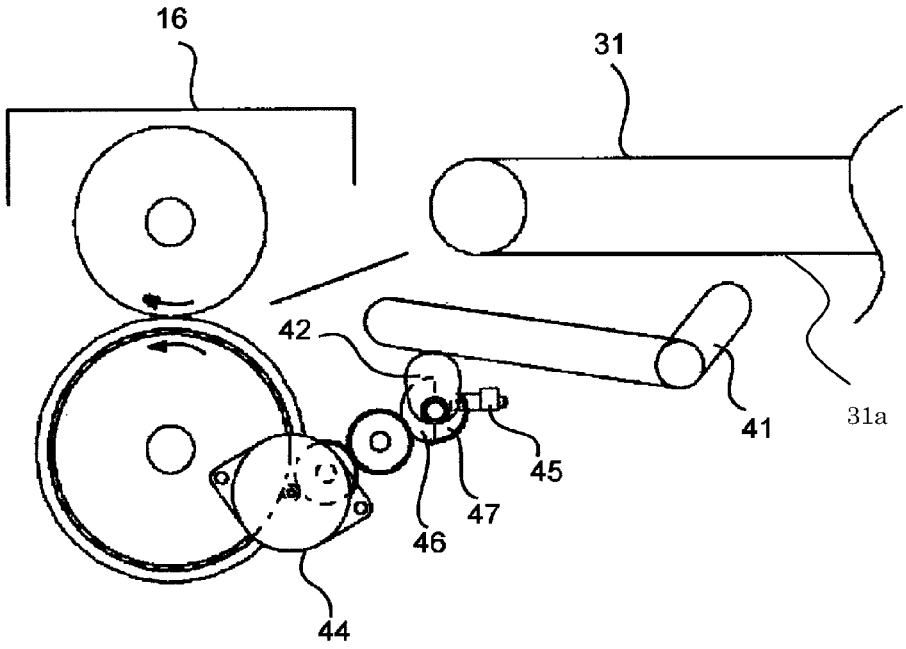
FIG. 3 is an essential portion enlarged sectional view of the image forming apparatus illustrated in FIG. 2.
Figure 4:
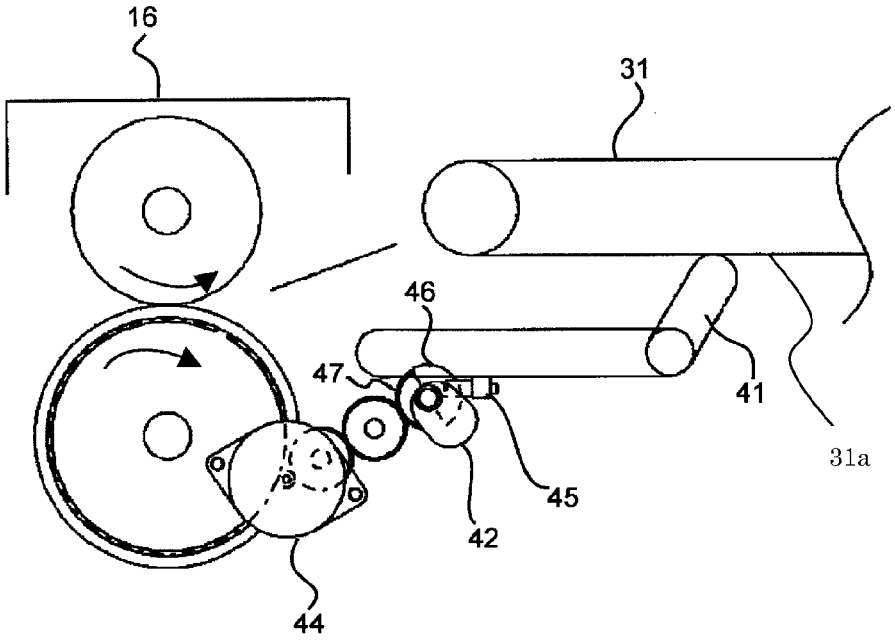
FIG. 4 is an essential portion enlarged sectional view of the image forming apparatus illustrated in FIG. 2.
Figure 5:
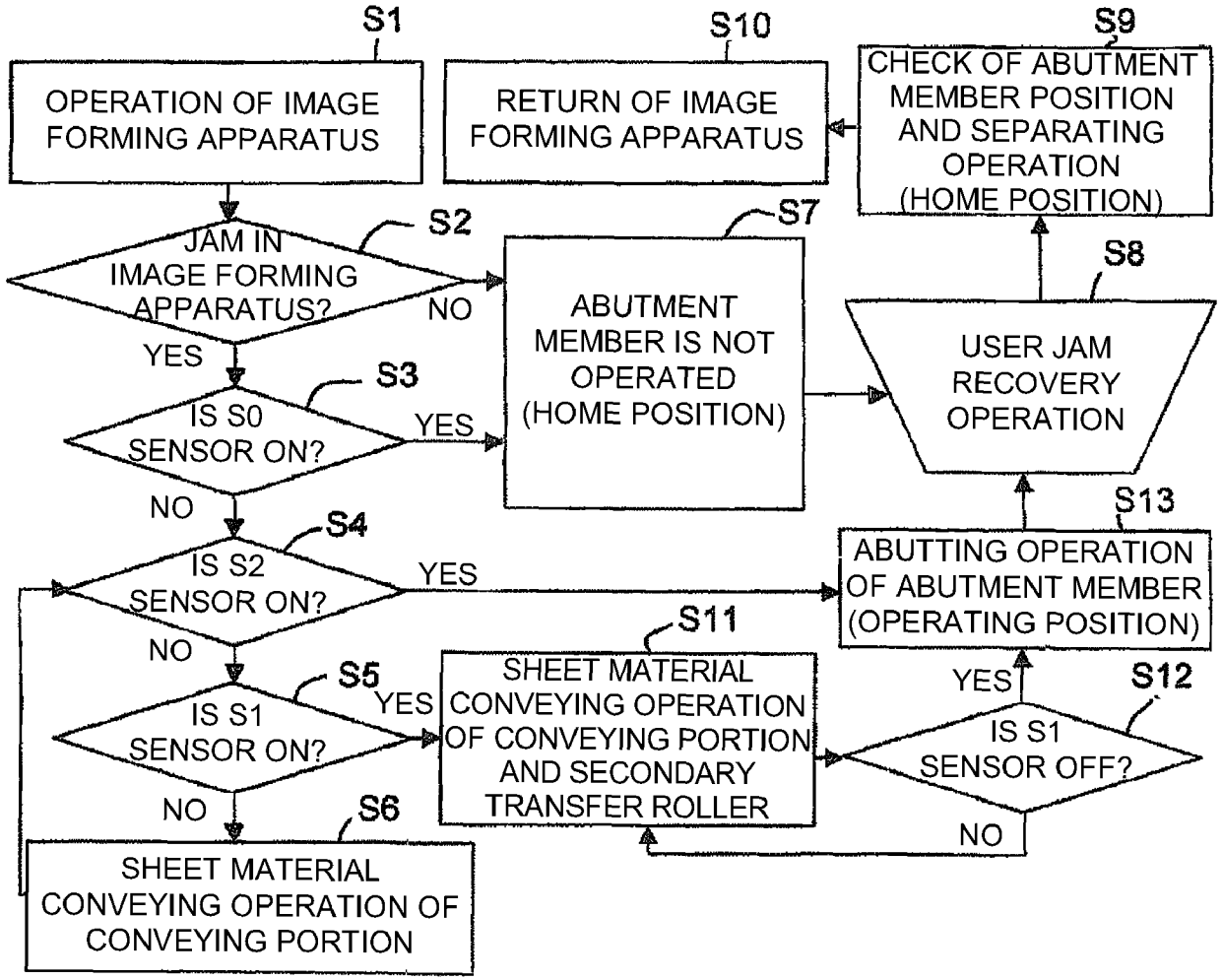
FIG. 5 is a flowchart describing control of the image forming apparatus of FIG. 1.
Figure 6:
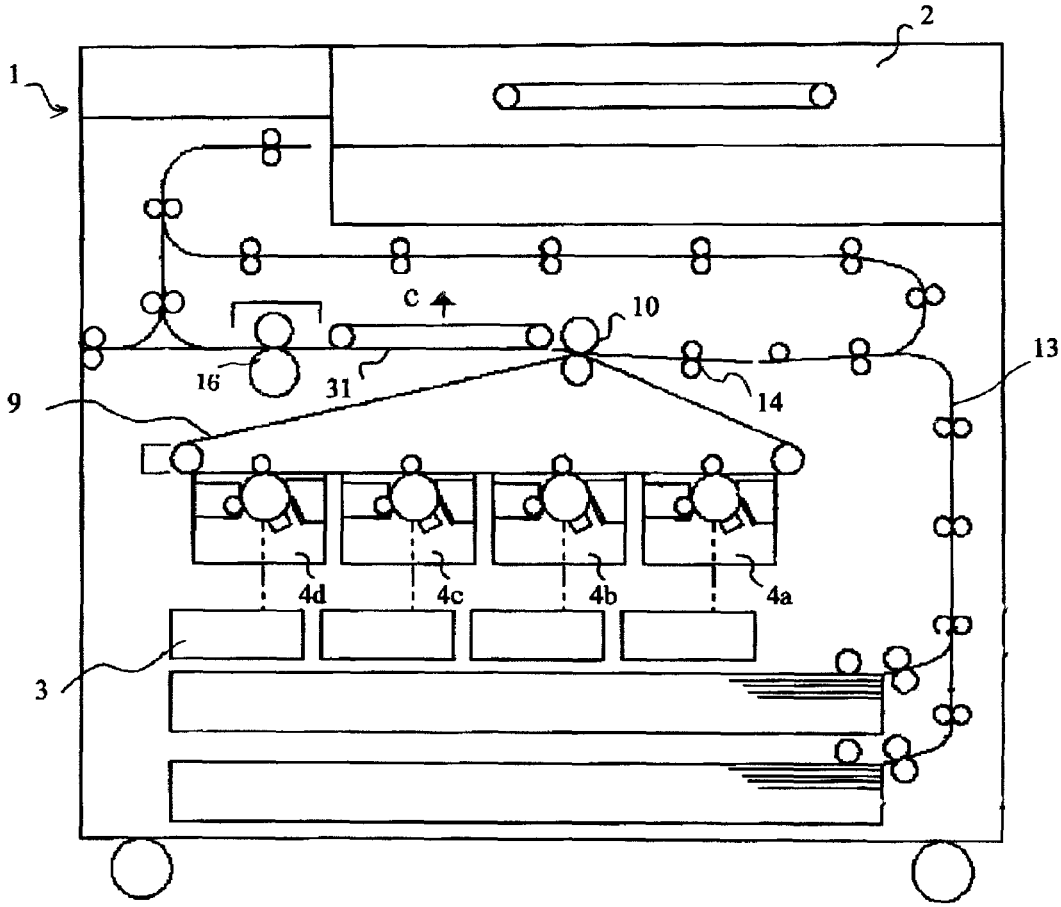
FIG. 6 PRIOR ART
FIG. 6 is a schematic longitudinal sectional view of an image forming apparatus in the related art.
Figure 7:
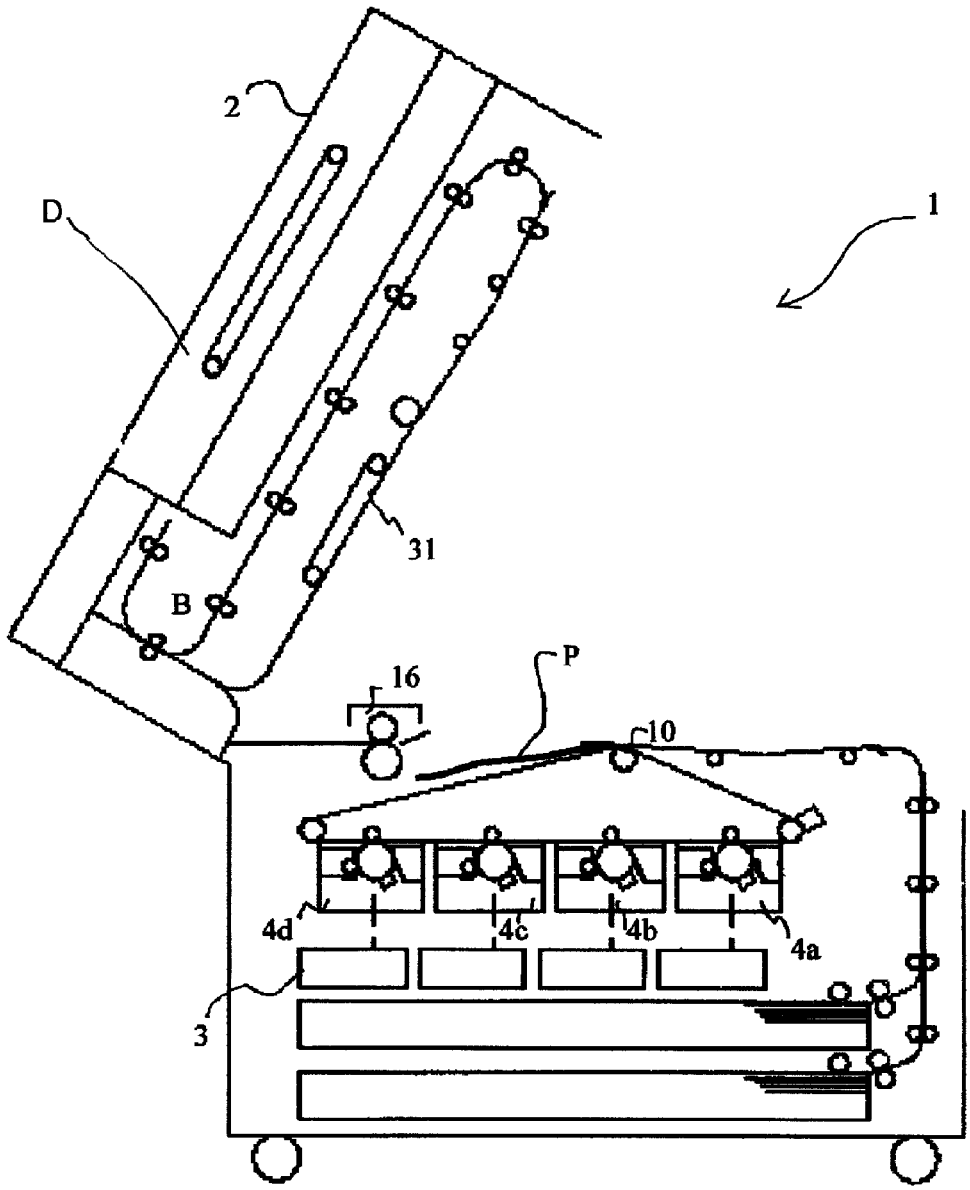
FIG. 7 PRIOR ART
FIG. 7 is a schematic longitudinal sectional view of another image forming apparatus in the related art.

FIGS. 2 to 4 are enlarged views around the pre-fixing conveying portion 31. FIG. 5 is a flowchart illustrating the driving sequence of the abutment member 41. The specific operation of the abutment member 41 in the event of jam occurrence will be described below.

In FIG. 2, both a distance L1 from a sheet detection sensor S1 to an abutting position G of the abutment member 41 and a distance L2 from the abutting position G to a sheet detection sensor S2 are shorter than the length of a minimum size sheet passable in the apparatus body 1.

A gear 47 having a one-way clutch is arranged in the driving transmission path from the motor 44 to the cam 42 and does not perform driving transmission to the cam 42 in the driving direction (arrow direction) of the pair of fixing rollers of the fixing device 16 (see FIG. 3).

The driving to the cam 42 is transmitted when the motor 44 is rotated in the opposite direction of the normal rotating direction. Furthermore, the rotation control of the motor 44 is performed by signals of the sheet detection sensors S0 to S2, a signal of a sensor flag 46 provided on the rotation axis of the cam 42, and detecting the rotation position of the cam 42 using a sensor 45 (see FIG. 4).

In the above configuration, in the event that jam occurrence of the previously conveyed sheet P is identified by the detection time of a sheet detection sensor S3 on the downstream side of the fixing device 16 in the conveying path, the operation of the abutment member 41 is controlled as illustrated in FIG. 5.

The image forming apparatus is operated (step S1). After a jam occurs (step S2), if the sheet detection sensor S0 detects a sheet P2, the abutment member 41 is not operated (step S7). The conveying unit E is drawn out from the apparatus body 1 to perform the removing process of the sheet P2 following a sheet P1 (step S8). When the conveying unit E is retracted into the apparatus body 1, the position of the abutment member 41 is checked (step S9) to return the image forming operation of the image forming apparatus (step 10).

After a jam occurs, when the sheet detection sensor S0 does not detect the sheet P2 (step S3), if the sheet detection sensor S2 detects the sheet P2 (step S4), the abutment member 41 abuts the sheet P2 to nip the sheet P2 between the abutment member 41 and the sheet conveying surface 31*a* of the pre-fixing conveying portion 31 (step S13).

The conveying unit E is drawn out from the apparatus body 1 in the state that the sheet P2 is nipped between the abutment member 41 and the pre-fixing conveying portion 31 to take out the sheet P2 (step S8). After the sheet P2 is taken out, the conveying unit E is retracted into the apparatus body 1. The abutment member 41 is returned to the separating position by driving the motor 44 according to the position detection information of the sensor flag 46 and the sensor 45 (steps S9 and S10).

After a jam occurs, when the sheet detection sensor S0 does not detect the sheet P2 (step S3) and the sheet detection sensor S2 also does not detect the sheet P2 (step S4), if the sheet detection sensor S1 detects the sheet P2 (step S5), the secondary transfer roller 10 and the pre-fixing conveying portion 31 are driven to convey the sheet P2 (step S11). When the sheet detection sensor S1 does not detect the sheet P2 (step S12), the abutment member 41 abuts the sheet P2 to nip the sheet P2 between the abutment member 41 and the sheet conveying surface 31*a* of the pre-fixing conveying portion 31 (step S13).

The conveying unit E is drawn out from the apparatus body 1 in the state that the sheet P2 is nipped between the abutment member 41 and the pre-fixing conveying portion 31 to take out the sheet P2 (step S8). After the sheet P2 is taken out, the conveying unit E is retracted into the apparatus body 1. The abutment member 41 is returned to the separating position by driving the motor 44 according to the position detection information of the sensor flag 46 and the sensor 45 (steps S9 and S10).

After a jam occurs, when the sheet detection sensor S0 does not detect the sheet P2 (step S3) and the sheet detection sensor S2 also does not detect the sheet P2 (step S4), if the sheet detection sensor S1 also does not detect the sheet P1, the pre-fixing conveying portion 31 is driven for a predetermined time. If the sheet P2 is located on the pre-fixing conveying portion 31, the sheet detection sensor S2 detects the leading portion of the sheet P2 (step S4). The abutment member 41 abuts the sheet P2 to nip the sheet P2 between the abutment member 41 and the sheet conveying surface 31*a* of the pre-fixing conveying portion 31 (step S13). Here, the predetermined time is the time during which when the sheet P2 is not detected by both of the sheet detection sensor S1 and the sheet detection sensor S2 and is stopped on the uppermost stream side, the sheet P2 is always conveyed to the position of the sheet detection sensor S2.

Thus, in this embodiment, the abutment member 41 abuts the sheet P2 to nip the sheet P2 between the abutment member 41 and the sheet conveying surface 31*a* of the pre-fixing conveying portion 31. Accordingly, when the conveying unit E is drawn out, the sheet P2 cannot be dropped from the conveying belt of the pre-fixing conveying portion 31 in the absence of a negative pressure or an electrostatic force in the pre-fixing conveying portion 31. The conveying unit E is drawn out by the user operation to draw out sheet P2 from the apparatus body 1. Accordingly, the jam recovery operation can be easily performed and the stop time of the apparatus due to the jam recovery can be reduced and the productivity can be improved at low cost.

The embodiment of the present invention has been described above in detail. The present invention is not limited to the description of the embodiment and various changes can be made in the scope without departing from the spirit of the invention described in the scope of the claims of the present invention.

For example, in the image forming apparatus in which the abutting position G is located so that L<L1 and L<L2, a plurality of abutment members 41 may be arranged so that L>L1 and L>L2 near the sheet detection sensors S1 and S2. The length L is the length of a minimum size sheet passable in the apparatus body 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-151189, filed Jun. 10, 2008, which is hereby incorporated by reference herein in its entirety.

What is claimed is:

1. An image forming apparatus comprising:

an apparatus body;

a transfer portion which transfers a toner image onto a lower surface of a sheet;

a fixing device which fixes the toner image transferred by the transfer portion onto the sheet;

a conveying portion which attracts the upper surface of the sheet with the toner image transferred onto the lower surface thereof by the transfer portion to convey the sheet to the fixing device;

an abutment member that abuts the sheet so that the sheet is nipped between abutment member and a sheet conveying surface of the conveying portion;

a driving unit which moves the abutment member so as to nip the sheet;

at least one sheet detection sensor which detects the sheet;

a jam determining unit which determines a jam in response to outputs from the at least one sheet detection sensor, wherein the apparatus body has a conveying unit which is drawn out from the apparatus body to remove a jammed sheet, wherein the conveying portion moves integrally with the conveying unit as the conveying unit is drawn out, wherein the abutment member is separated from the sheet in response to the jam determining unit determining that a jam is not occurring, and wherein the driving unit moves the abutment member so as to nip the sheet in response to the jam determining unit determining that a jam is occurring, and said abutment member continues to nip the sheet when the conveying unit is drawn out.

2. The image forming apparatus according to claim 1, wherein the at least one sheet detection sensor comprises an upstream sheet detection sensor which detects when a sheet is arranged upstream of the conveying portion, and in response to the upstream sheet detection sensor detecting the sheet when the jam determining unit determines a jam, the detected sheet is conveyed until the sheet is not detected by the upstream sheet detection sensor.

3. The image forming apparatus according to claim 2, wherein the at least one sheet detection sensor comprises a downstream sheet detection sensor which detects when a sheet is arranged downstream of the conveying portion, and in response to both the upstream sheet detection sensor and the downstream sheet detection sensor not detecting the sheet when the jam determining unit determines a jam, the conveying portion is driven for a predetermined time necessary for conveying the sheet to the downstream sheet detection sensor.

* * * * *